United States Patent [19]

Thayer

[11] 4,299,156

[45] Nov. 10, 1981

[54] AXIAL FLOW VALVE

[76] Inventor: Orla E. Thayer, P.O. Box 473, Waldport, Oreg. 97394

[21] Appl. No.: 74,553

[22] Filed: Sep. 11, 1979

Related U.S. Application Data

[63] Continuation-in-part of Ser. No. 927,565, Jul. 24, 1978, Pat. No. 4,213,371, which is a continuation of Ser. No. 764,028, Jan. 31, 1977, Pat. No. 4,112,806.

[51] Int. Cl.[3] ..... G10D 9/04

[52] U.S. Cl. ..... 84/390

[58] Field of Search ..... 84/387–394

[56] References Cited

U.S. PATENT DOCUMENTS 455,562 7/1891 Gates ..... 84/393

1,703,411 2/1929 Steinmetz ..... 84/390

FOREIGN PATENT DOCUMENTS 559300 9/1932 Fed. Rep. of Germany ..... 84/392

*Primary Examiner*—Lawrence R. Franklin

*Attorney, Agent, or Firm*—Klarquist, Sparkman, Campbell, Leigh, Whinston and Dellett

[57] ABSTRACT

A rotary valve for selectively inserting and removing a slide loop from the sound path of a musical instrument is disclosed. The valve includes a rotor having two sound passages entending therethrough, which are no more than slightly curved. These passages align axially with the instrument's lead pipe, main bore, and slide loop ends so that a minimum of undesired harmonics are added to the tone of the instrument due to presence of the valve in the sound path.

17 Claims, 27 Drawing Figures

FIG. 8
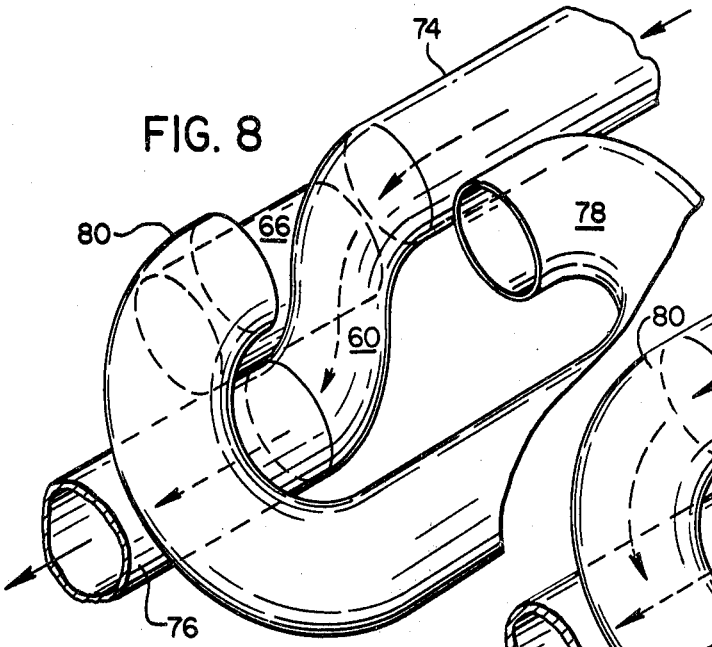
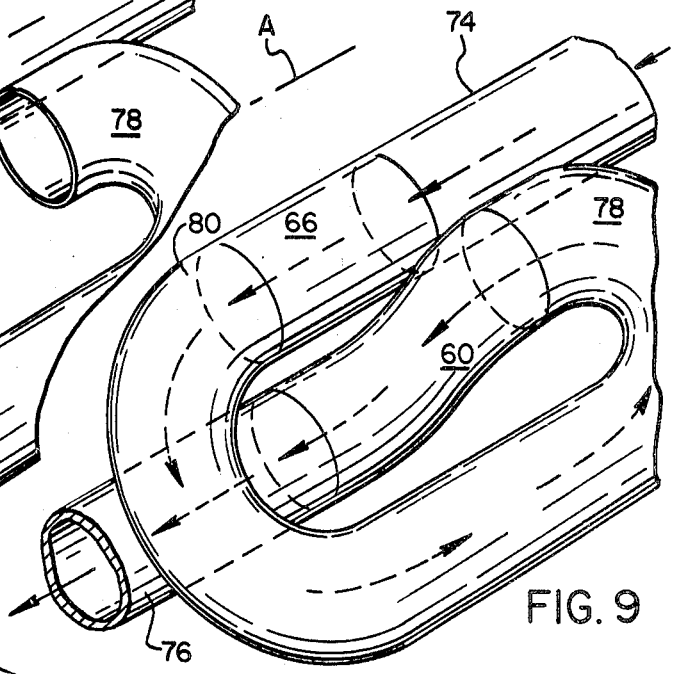
FIG. 9
FIG. 10
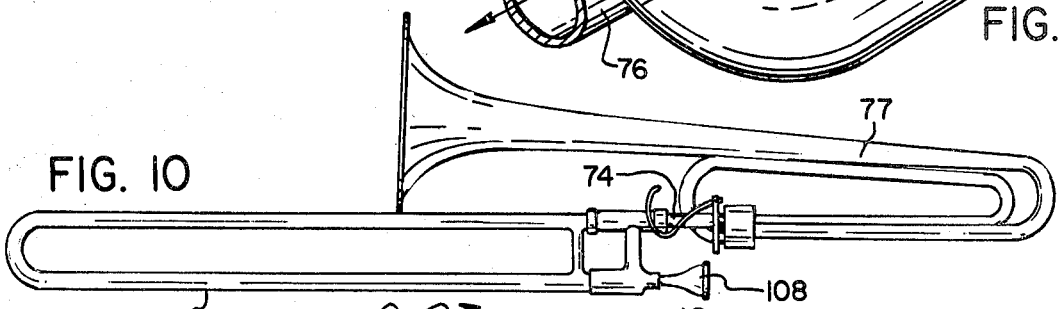
FIG. 11
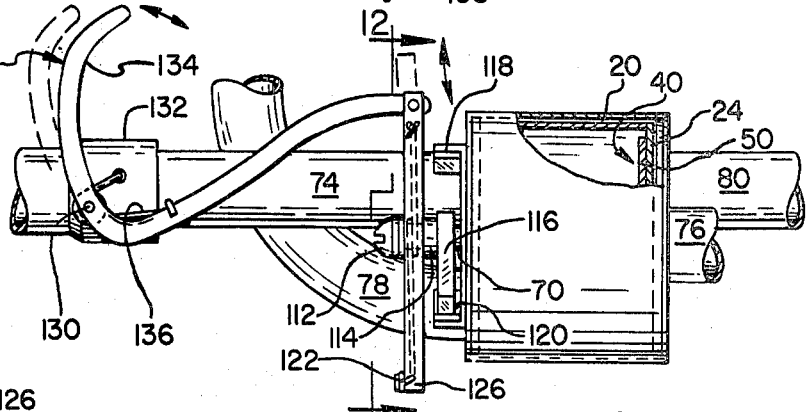
FIG. 12
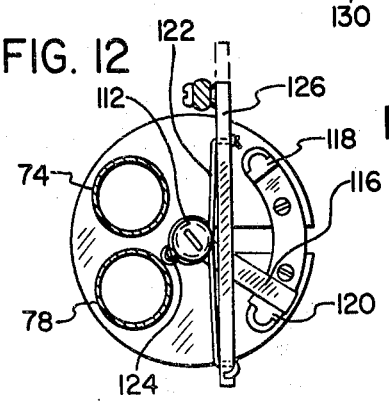
FIG. 13
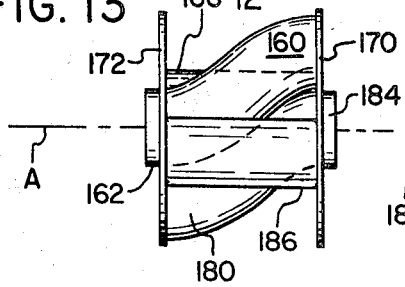
FIG. 14
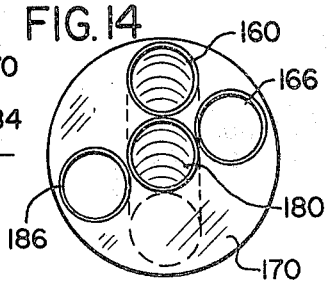

FIG. 16
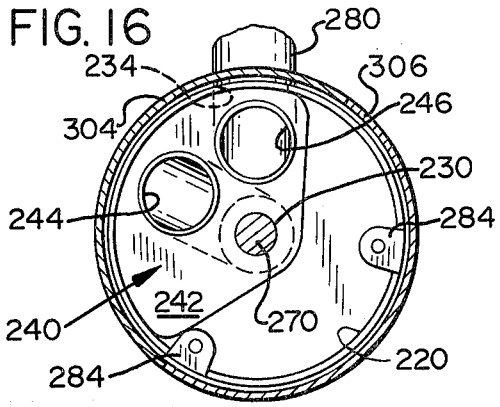
FIG. 15
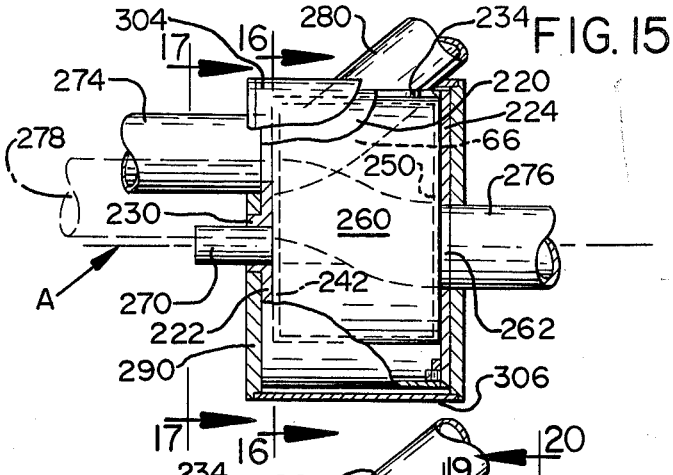
FIG. 17
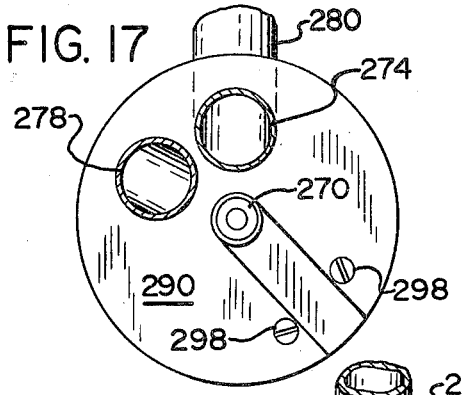
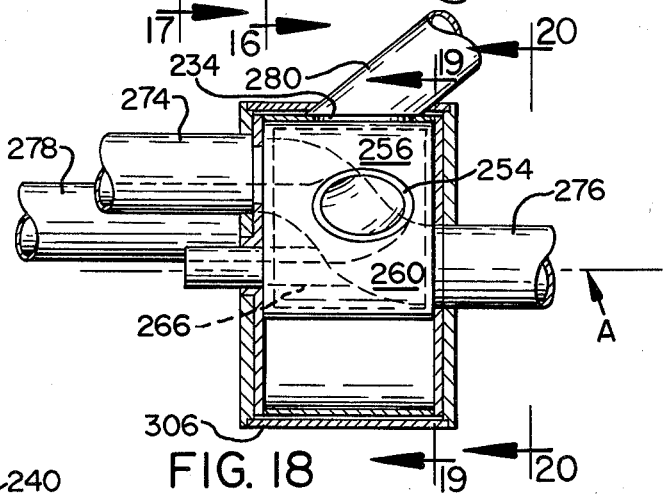
FIG. 18
FIG. 19
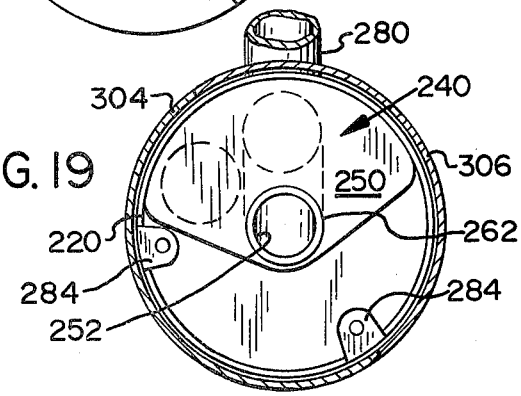
FIG. 20
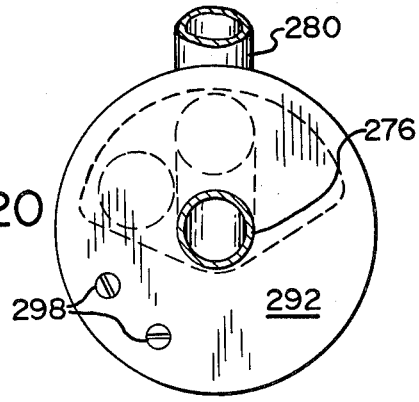
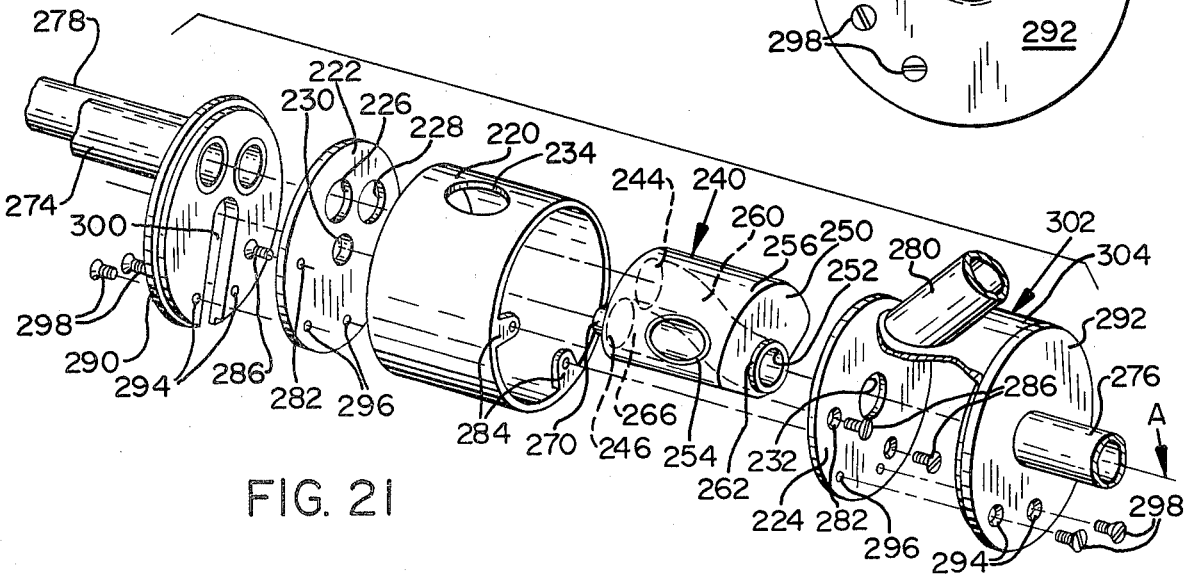
FIG. 21

FIG. 22
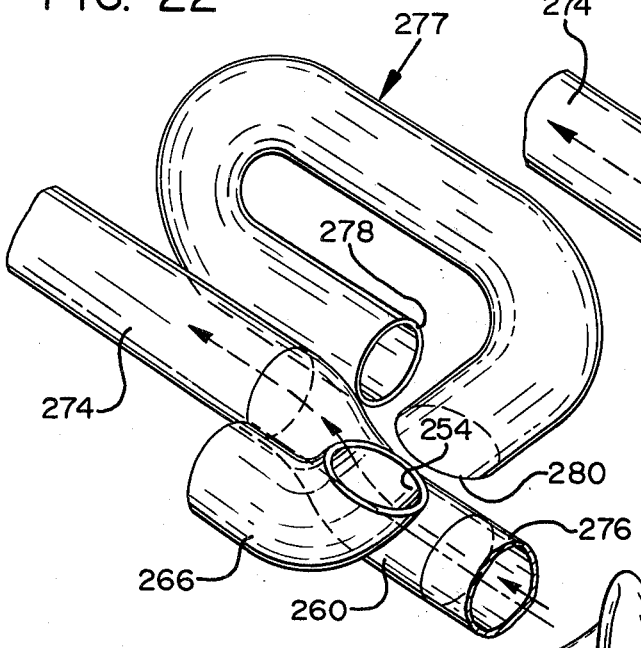
FIG. 23
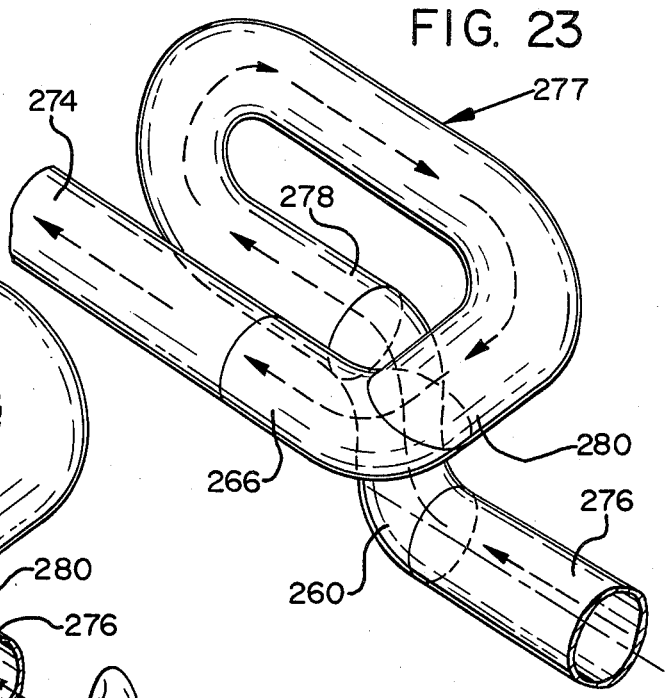
FIG. 24
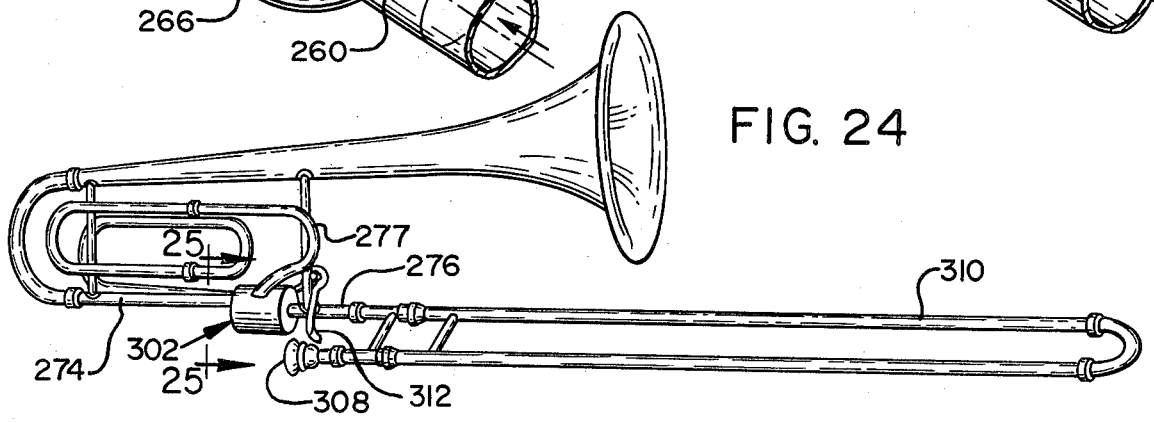
FIG. 25
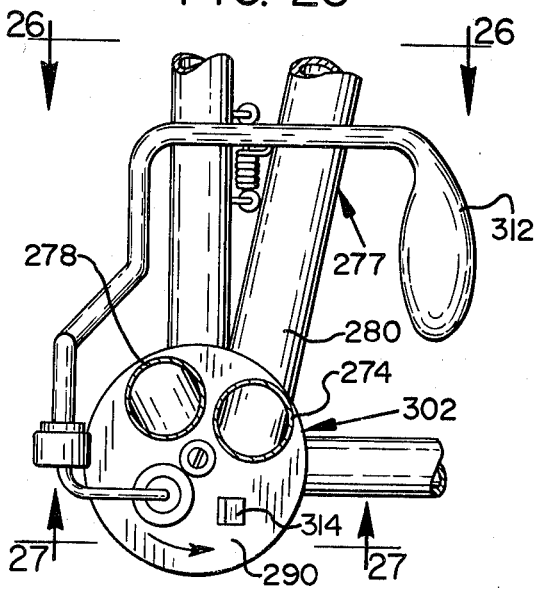
FIG. 27
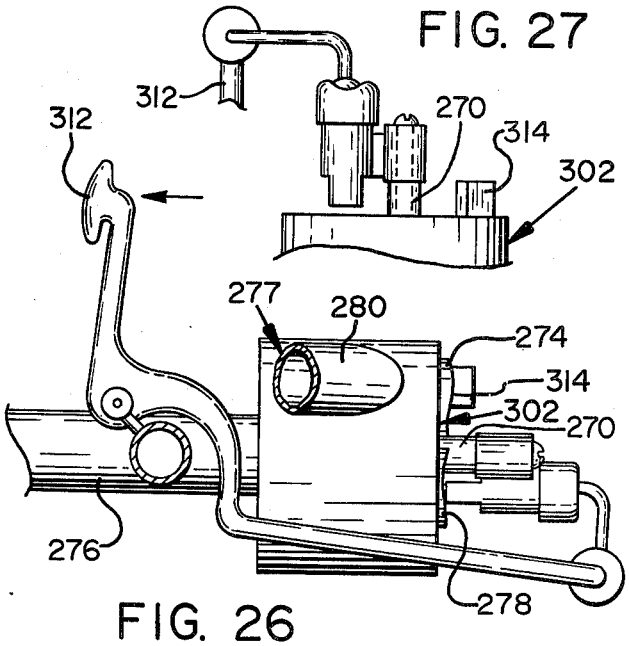
FIG. 26

AXIAL FLOW VALVE

CROSS-REFERENCE TO RELATED APPLICATIONS

This is a continuation-in-part of application Ser. No. 927,565, filed July 24, 1978, now U.S. Pat. No. 4,213,371, which is a continuation of application Ser. No. 764,028, filed Jan. 31, 1977, now U.S. Pat. No. 4,112,806.

BACKGROUND OF THE INVENTION

This invention relates to a rotary fluid flow switch and more specifically to a rotary air valve of a musical instrument.

Rotary valves are highly regarded for use in musical instruments due to their quick action and relative simplicity of structure as compared to piston type valves. Prior rotary valves suffer, however, from the disadvantage that they add overtones to the sound of the instrument when played. These overtones are the result of sharp bends in the air passage which occur either inside the valve rotor or at the junction of the valve rotor with the instrument tubing. Whenever the sound waves traveling through an instrument's sound passage are required to make a sharp turn, a certain portion of the waves reflects off the inside walls of the passage. Such a partial reflection reduces the energy of the fundamental wave and produces an undesirable overtone.

SUMMARY OF THE INVENTION

The present invention is a valve which adds substantially fewer unwanted harmonics to an instrument's tone than do prior art valves. The lead pipe and main bore of the instrument align axially with the passages of the valve rotor so that sound waves enter, pass through, and leave the valve without substantially changing direction or being deflected off of the passage walls. In one embodiment, the valve is constructed with only two passages, one of which extends straight through the rotor and the other of which curves only slightly. In another, related embodiment, two slightly curved passages extend through the rotor.

An object of the invention is to improve the accoustic performance of all common, valved brass wind instruments, such as trumpets, alto horns, single French horns, trombones, baritones and tubas, by providing a valve which does not have the abruptly angled sound passages of prior art rotary and piston valves.

An additional object of this invention is therefore to provide a rotary valve having passages which extend in a substantially straight path therethrough.

Another object is to provide a rotary valve in which the instrument's lead pipe and main bore align axially with the passages through the valve's rotor.

A further object is to provide a rotary valve having a rotor which requires only two passages extending axially therethrough.

A still further object of the invention is to provide a rotary valve having a passage which enters or alternatively departs from the rotor coaxially to its axis of rotation.

Also, it is an object of the present invention to provide a rotary valve which is of simple design, requires a minimum of parts, is inexpensive and easy to construct.

Other objects and advantages of this invention will become apparent to those skilled in the art upon reading the specification.

BRIEF DESCRIPTION OF THE DRAWINGS

FIG. 8 is an isometric schematic view showing the rotor of the valve according to the present invention in a first or direct flow position;

FIG. 9 is an isometric schematic view showing the valve rotor of FIG. 8 in a second or diverted flow position;

FIG. 10 is side elevation of a B-flat trombone incorporating a valve according to the present invention;

FIG. 11 is a plan view on an enlarged scale of the valve shown in FIG. 10;

FIG. 12 is a vertical sectional view taken along line 12—12 of FIG. 11;

FIG. 13 is a side elevation of a valve rotor according to the present invention for simultaneously engaging two slide loops;

FIG. 14 is an end elevation of the valve rotor shown in FIG. 13;

FIG. 15 is a partially broken away top view of a second valve according to the present invention with a rotor located in a diverted flow position;

FIG. 16 is a vertical sectional view taken along line 16—16 of FIG. 15;

FIG. 17 is a vertical sectional view taken along line 17—17 of FIG. 15;

FIG. 18 is a partially broken away top view of the second valve with its rotor in a direct flow position;

FIG. 19 is a vertical sectional view taken along line 19—19 of FIG. 18;

FIG. 20 is a vertical sectional view taken along line 20—20 of FIG. 18;

FIG. 21 is an isometric exploded view of the valve shown in FIGS. 15 through 20;

FIG. 22 is an isometric schematic view showing the rotor of the second valve according to the present invention in a first or direct flow position;

FIG. 23 is an isometric schematic view showing the valve rotor of FIG. 22 in a second or diverted flow position;

FIG. 24 is side elevation of a B-flat trombone incorporating a valve according to the present invention;

FIG. 25 is a vertical sectional view taken along line 25—25 of FIG. 24;

FIG. 26 is a horizontal sectional view taken along line 26—26 of FIG. 25; and FIG. 27 is a partial bottom view taken along line 27—27 of FIG. 25.

DESCRIPTION OF THE PREFERRED EMBODIMENT

Figure 1:
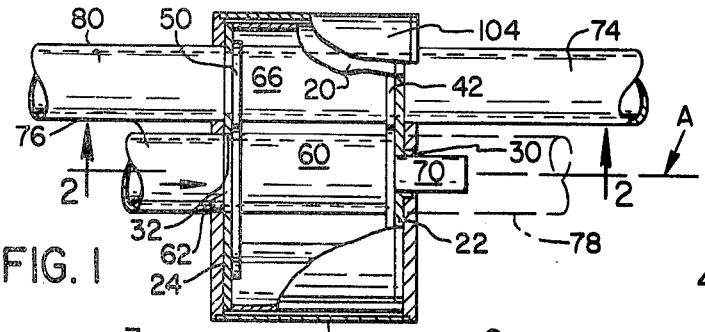
FIG. 1 is a partially broken away top view of a first valve according to the present invention.
Figure 5:
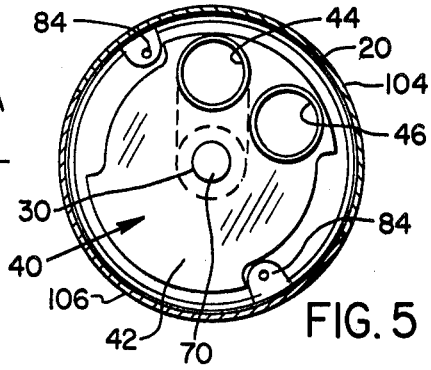
FIG. 5 is a vertical sectional view taken along line 5—5 of FIG. 2.
Figure 2:
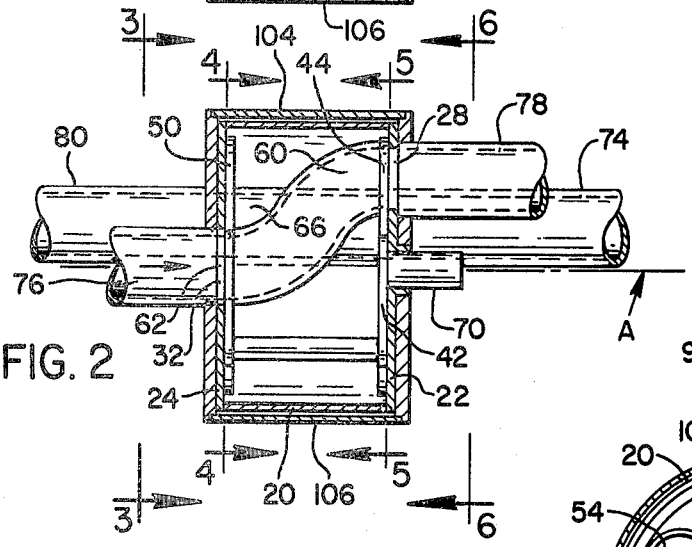
FIG. 2 is a vertical sectional view taken along line 2—2 of FIG. 1.
Figure 6:
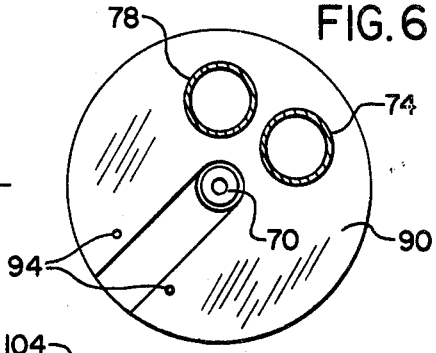
FIG. 6 is a vertical sectional view taken along line 6—6 of FIG. 2.
Figure 4:
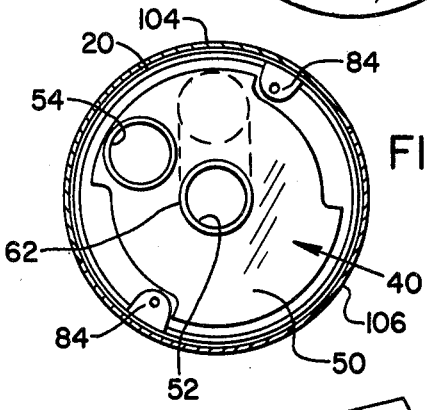
FIG. 4 is a vertical sectional view taken along line 4—4 of FIG. 2.
Figure 3:
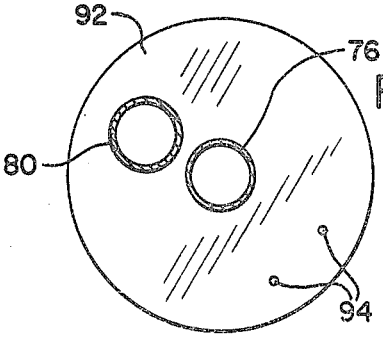
FIG. 3 is a vertical sectional view taken along line 3—3 of FIG. 2.

A first valve according to the present invention is shown in FIGS. 1 through 7. This valve has a casing which includes a tubular body 20, a first body end plate 22 fixed on one end of the body and positioned so that its flat surfaces are perpendicular to the longitudinal axis 'A' of the body, and a second body end plate 24 secured on the other end of the body 20 and parallel to the first body end plate 22. The first body end plate 22 defines two body inlet apertures. One of the inlet apertures is a primary body inlet aperture 26 having an axis which is parallel to but displaced from the axis A. The other is a secondary body inlet aperture 28 the center of which is displaced an equal distance away from the longitudinal axis A as is the center of the primary body inlet aperture 26. The first body end plate 22 also includes a circular shaft aperture 30 which is positioned coaxially to the longitudinal axis A. The second body end plate 24 defines two body outlet apertures. One of the outlet apertures is a circular primary body outlet aperture 32 coaxially aligned with the longitudinal axis A of the body 20. The other is a secondary body outlet aperture 34 positioned opposite said primary body inlet aperture 26.

A rotor indicated generally at 40 is located inside the casing. At one end of the rotor 40 is a substantially disc-shaped first rotor end plate 42 having a diameter slightly less than the inside diameter of the body 20. This first rotor end plate is positioned with one of its flat surfaces adjacent the first body end plate 22. The first rotor end plate 42 includes a primary rotor inlet aperture 44 adapted to register alternately with the primary body inlet aperture when the rotor is in a first position and with the secondary body inlet aperture when the rotor is in a second position. The first rotor end plate also includes a secondary rotor inlet aperture 46 which is positioned to register with the primary body inlet aperture 26 when the rotor is in the second position. The rotor inlet apertures are preferably the same size and shape as the body inlet apertures.

A substantially disc-shaped second rotor end plate 50 having the same diameter as the first rotor end plate 42 is positioned with one of its flat surfaces adjacent the second body end plate 24. The second rotor end plate 50 defines primary and secondary rotor outlet apertures 52 and 54. The primary rotor outlet aperture 52 remains in alignment with the primary body outlet aperture 32 at all times. The secondary rotor outlet aperture 54 registers with the secondary body outlet aperture 34 only when the rotor 40 is in the second position. The rotor outlet apertures and the body outlet apertures are preferably the same size and shape.

In this embodiment a rigid primary rotor tube 60 extends through the primary rotor inlet aperture 44 between the rotor end plates, and through the primary rotor outlet aperture 52. Preferably a cylindrical extension 62 of the primary rotor passage 60 further extends through the primary body outlet aperture 32 so that the extension 62 is journaled within the aperture 32 of the second body end plate 24. A rigid secondary rotor tube 66 extends through the secondary rotor inlet aperture 46 between the rotor end plates and then through the secondary rotor outlet aperture 54. The axis of this preferred secondary rotor tube 66 is perpendicular to the rotor end plates and coaxial to the secondary rotor inlet aperture 46 and the secondary rotor outlet aperture 54. The rotor tubes 60, 66 provide passages for air traveling through the rotor 40. Other rotor constructions could be used. For instance, a solid cylindrical core, having passages extending therethrough, would be equally suitable.

A shaft 70, extending from the outer side of the second rotor end plate 42, is coaxial to the longitudinal axis A. This shaft 70 extends through the shaft aperture 30 so that the rotor can be rotated about the axis A by rotating the shaft 70.

The best tone quality is achieved in a musical instrument if sound waves traveling through its valves encounter a minimum amount of resistance. In the present invention exceptionally low resistance is accomplished by constructing the secondary rotor tube 66 of a straight, rigid piece of tubing which is positioned perpendicular to the rotor end plates. The primary rotor tube 60 is preferably shaped as a slight S-curve and has end portions positioned to be substantially perpendicular to the rotor end plates. By mounting the instrument tubes so that their axes are perpendicular to the rotor end plates at the points where they are mounted on the body end plates, a minimum amount of resistance is encountered during the transfer of sound waves between the instrument tubes and the rotor passages. The specific instrument tubes referred to include a lead pipe which extends from the instrument's to the valve, a main bore which extends from the valve to the instrument's bell, and a slide loop which is a passageway of fixed length connected at each end to the valve and includable by the valve in the sound path of the instrument to change the pitch of tone being played. In most instances such slide loops include a slide which can be moved a short distance to tune the instrument to the proper pitch.

A slightly less desirable alternative to the S-shaped primary rotor tube 60 is a straight tube extending diagonally between the rotor end plates. Although a diagonal tube would be a substantial improvement over the prior art, it would not be as satisfactory as the S-shaped tube, since the ends of a diagonal primary rotor tube would not align axially with the instrument tubes. This would introduce some resistance to the transfer of sound waves between the primary rotor passage and the instrument tubes.

As previously described, the rotor 40 may be rotated between a first position in which the primary rotor inlet aperture 44 registers with the primary body inlet aperture 26 and a second position in which each of the rotor apertures registers with a body aperture.

In the embodiment of FIGS. 1 through 7, a valve according to the present invention is positioned between tubes which correspond to the tubes of a musical instrument. A lead pipe 74 extends from the mouthpiece of the instrument and connects to the primary body inlet aperture 26. A main bore 76 is connected to the primary body outlet aperture 32; and opposite ends 78, 80 of a slide loop 77 connect to the secondary body inlet aperture 28 and the secondary body outlet aperture 34.

Figure 7:
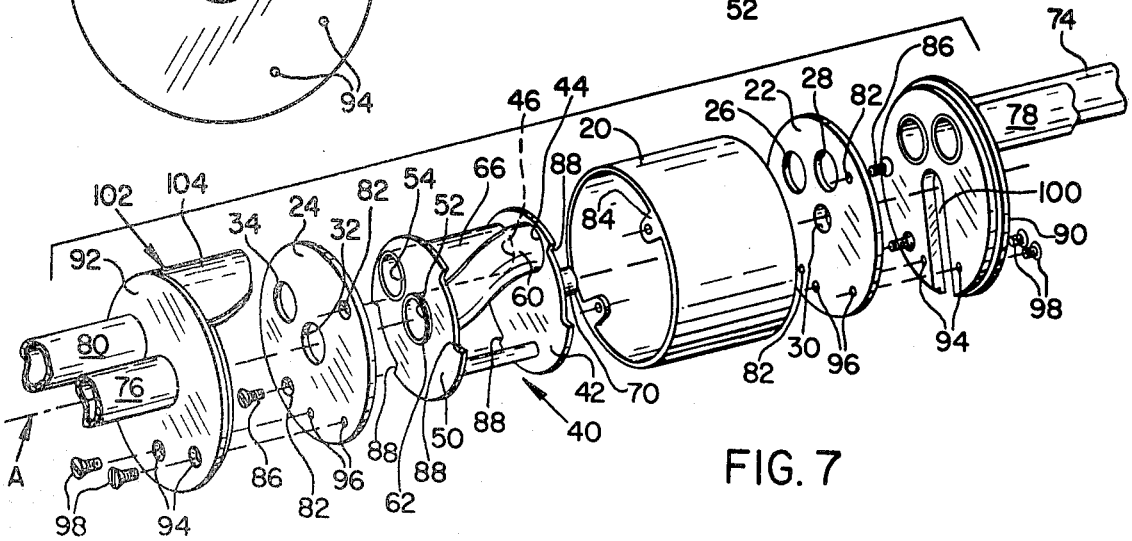
FIG. 7 is an isometric exploded view of the valve shown in FIGS. 1 through 6.

An exploded view of the valve shown in FIGS. 1 through 6 appears in FIG. 7. This figure shows several additional features which are useful when the valve is incorporated into a musical instrument. The body end plates 22 and 24 are provided with screw holes 82. The body 20 is provided with inwardly extending ears 84 having threaded holes. The holes 82 and threaded holes in the ears 84 are adapted to receive screws 86 which secure the body end plates to the body 20. In order for the rotor to rotate inside the body when the end plates are attached in this fashion it is necessary that notches 88 be provided along the edges of the otherwise circular rotor end plates 42, 50.

For easy removal of the valve structure from the musical instrument, mounting plates are permanently attached to the instrument tubes and spaced apart at a distance just sufficient to contain the valve assembly with the body end plates 22, 24 in contact with the plates 90, 92 respectively. The lead pipe 74 and one end 78 of the slide loop 77 are permanently affixed to the mounting plate 90. The main bore 76 and the other end 80 of the slide loop 77 are likewise fixed to the other mounting plate 92. Each mounting plate is provided with a pair of orifices which exactly register with the orifices of the adjacent body end plate when the valve assembly is properly positioned between the mounting plates. With the valve assembly in this position, screw holes 94 in the mounting plates register with threaded screw holes 96 so that screws 98 can secure the valve assembly in position.

The valve assembly is quickly removed from between the mounting plates 90, 92 by unscrewing the screws 98 and sliding the valve assembly from between the mounting plates. A slot 100 is provided in the mounting plate 90 through which the shaft 70 slides as the valve assembly is removed.

A casing cover 102 which surrounds the body 20 and extends between the mounting plates 90, 92 comprises two hemicylindrical segments. One of the segments 104 is permanently mounted on the mounting plates 90, 92. The other segment 106 is removable to expose the valve assembly. By simply removing the screws 98, the entire valve may be removed for servicing. The valve assembly itself may be completely disassembled by removing four additional screws 86.

The rotation of the rotor about the longitudinal axis A is illustrated schematically in FIGS. 8 and 9. FIG. 8 shows the rotor in the normal flow or first position. In this position the primary rotor tube 60 connects the lead pipe 74 directly to the main bore 76.

When the rotor is rotated about the axis A to the second or diverted flow position shown in FIG. 9, the secondary rotor tube 66 connects the lead pipe 74 with one end 80 of the slide loop, and the primary rotor tube 60 connects the other end 78 of the slide loop with the main bore 76. Thus when the valve is in the first position the sound waves can travel directly between the lead pipe 74 and the main bore 76. When the valve is in the second position sound waves must pass through the slide loop 77 when traveling between the lead pipe 74 and the main bore 76.

FIGS. 10 through 13 depict a valve according to the present invention incorporated in a musical instrument. More specifically, FIG. 10 shows a B-flat trombone which includes a single slide loop 77. By rotating the valve, the slide loop 77 may be added to the sound path so that the fundamental pitch of the trombone is lowered to the key of F. The trombone has a mouthpiece 108 and a slide 110 which are portions of the lead pipe 74. The lead pipe connects to primary body inlet aperture of the valve. One end 78 of the slide loop 77 is connected to the secondary body inlet aperture. The other end 80 is connected to the secondary body outlet aperture. The main bore 76 is connected to the primary body outlet aperture.

FIGS. 11 and 12, enlarged views of the preferred valve incorporated in a musical instrument, show a means for rotating the valve shaft and rotor. This rotating means is of the type commonly known as the American string drive. Mounted on the end of the shaft 70 by a screw 112 is a sleeve 114 and a radially extending arm 116. Stops 118, 120 are provided to engage the arm 116. These stops assure positive alignment between rotor apertures and body apertures. A cord 122 is wrapped around the circumference of the sleeve 114 and is secured by a screw 124. Opposite ends of the cord are fixed on opposite ends of a rail 126 with the cord stretched tightly. One end of the rail 126 is pivotally connected to a thumb lever 128. The thumb lever 128 is pivotally mounted, at a pivot point 130, on a collar 132 which is disposed about the lead pipe 74. The lever includes a free end 134 which is manually movable to rotate the valve rotor 40. A spring 136 exerts a downward pressure on the lever 112 at a point between the pivot point 130 and the rail 126 so that the rail is maintained in the lowered position shown by solid lines in FIGS. 11 and 12 unless moved by rotation of the thumb lever 128.

In this embodiment when the rail 126 is in the lowered position, the rotor is in the first or direct flow position shown schematically in FIG. 8. In this position the primary rotor tube 60 directly connects the lead pipe 74 with the main bore 76. When the free end 134 of the lever 128 is pulled away from the valve, the lever 128 pivots about the point 130 so that the rail 126 is lifted to the position shown in broken lines. As the rail moves upwardly, the cord 122 rotates the sleeve 114 which in turn causes the shaft 70 to rotate (counterclockwise in FIG. 12).

When the shaft 70 is fully rotated so that the arm 116 engages the stop 118, the rotor has moved to a position which corresponds to the second or diverted flow position of FIG. 9. In this position the primary rotor tube 60 connects the one end 78 of the slide loop to the main bore 76 while the secondary rotor tube 66 provides a passageway which directly connects the lead pipe 74 with the other end 80 of the slide loop so that the sound path now includes the extra length of the slide loop 77 and the fundamental pitch of the instrument is lowered (in the case of the B-flat trombone, to the key of F).

The efficient operation of valves according to the present invention is not affected by reversing the structure so that the lead pipe 74 is connected to the primary body outlet aperture 32 and the main bore 76 is connected to the primary body inlet aperture 26. Such reversed valves will operate in substantially the same fashion.

Because valves according to the present invention function identically when the lead pipe and main bore are exchanged, it is possible to include an additional pair of rotor tubes and additional sets of rotor and body apertures in a single valve assembly thereby forming a dual valve. This is an important feature of the present invention because certain types of instruments require such dual valves, the most notable being the double French horn and double baritone. In these, the instrument is fitted with two sets of standard valves with their associated slide loops. Each set of valves is provided with properly proportioned slide tube lengths for a specific musical key or pitch. As an example, in the usual double French horn, a primary set of valves may be pitched in the key of F while a secondary set of valves may be pitched in the key of B-flat. An additional diverter valve is provided to direct the sound path through the desired set of valves. In practice each valve is in fact a dual valve which includes two single valves, one from each set, which are linked together so that a single set of finger keys can operate the valves of both the primary and secondary sets.

Beyond this application the dual valve configuration may be utilized in a specific class of instruments called compensating horns. In these it has been found desirable to "compensate" for overall length deficiencies when more than one valve is operated at a time. This is accomplished by providing dual valves to add small secondary slide loops to the sound path, when more than one valve is functioning. Because compensating horns have previously used two standard single valves linked together to make dual valves, such compensating horns have, of necessity, included tortuous sound paths. A dual valve according to the present invention is advantageous in such compensating horns because it includes two single, axial valves in one valve body to simultaneously control the inclusion of both a primary and a secondary slide loop. Such a dual, axial valve reduces the nunber of valve bodies needed in a compensating horn and also lessens the tortuousness of the horn's sound path.

A rotor according to the present invention for use in such a dual, axial valve is shown in FIGS. 13 and 14. In these figures a primary rotor tube 160, including an extension 162, and a secondary rotor tube 166 correspond to similarly named members of FIGS. 1 through 7. The dual valve rotor additionally includes tertiary rotor tube 180 which extends through the center of a first rotor end plate 170, through the rotor, and then through a peripheral portion of a second end plate 172. An extension 184 of the tertiary rotor tube 180 extends outwardly from a center of the first rotor end plate 170. The extension 184 is adapted to be journaled in a circular tertiary body inlet aperture of an adjacent body end plate so that the extension 184 is coaxial with the axis A. A quatenary rotor tube 186 extends through a peripheral portion of the first rotor end plate 170, between the two rotor end plates, and then through the second rotor end plate 172. The quatenary rotor tube preferably extends straight through the rotor perpendicular to the rotor end plates. The rotor outlets, through which the tertiary and the quatenary rotor tubes extend, have centers which are equidistant from the axis A.

A suitable casing, having four apertures in each body end wall corresponding to the four apertures through each rotor end plate, is necessary for containing the dual valve rotor. Because rotor tube extensions are journaled in axial apertures of both its body end plates, no shaft is available to rotate a dual valve. Other suitable means for rotating the dual valve, such as an arm which is mounted on the rotor and which extends through a slot in the body, must be used. The dual valve operates in the same fashion as the single valve previously described, except that the dual valve allows a musician to simultaneously include or exclude two slide loops by moving the rotor between first and second positions.

A second valve according to the present invention is shown in FIGS. 15 through 21. This valve has a casing which includes a tubular body 220, a first body endplate 222 fixed on one end of the body and positioned so that it's flat surfaces are perpendicular to the longitudinal axis "A" of the body, and a second body endplate 224 secured on the other end of the body 220 and parallel to the first body endplate 222. The first body endplate 222 defines two body outlet apertures. One of the outlet apertures is a primary body outlet aperture 226 having an axis which is parallel to but displaced from the axis "A". The other is a secondary body outlet aperture 228 the center of which is displaced an equal distance away from the longitudinal axis "A" as is the center of the primary body outlet aperture 226. The first body endplate 222 also includes a circular shaft aperture 230 which is positioned coaxially to the longitudinal axis "A". The second body endplate 224 defines a circular primary body inlet aperture 232 coaxially aligned with the longitudinal axis "A" of the body 220. The body 220 defines a secondary body inlet aperture 234 which, preferably, is generally elliptical as will be explained below.

A rotor indicated generally at 240 is located inside the casing. At one end of the rotor 240 is a first rotor endplate 242 having a curved edge in a radius slightly less than the inside radius of the body 220. This first rotor endplate is positioned with one of its flat surfaces adjacent the first body endplate 222. The first rotor endplate 242 includes a primary rotor outlet aperture 244 adapted to register alternately with the primary body outlet aperture 226 when the rotor is in a first position and with the secondary body outlet aperture 228 when the rotor is in a second position. The first rotor endplate also includes a secondary rotor outlet aperture 246 which is positioned to register with the primary body outlet aperture 226 when the rotor is in the second position. The rotor outlet apertures are preferably the same size and shape as the body outlet apertures.

A second rotor endplate 250 having an edge with the same radius as the curved edge of the first rotor end plate 242 is positioned with one of its flat surfaces adjacent the second body endplate 224. The second rotor endplate 250 defines a primary rotor inlet aperture 252. A secondary rotor inlet aperture 254 is defined in a hemicylindrical side plate 256 of the rotor 240. The side plate 256 has a slightly smaller outside diameter than the inside diameter of the body 220. The primary rotor inlet aperture 252 remains in alignment with the primary body inlet aperture 232 at all times. The secondary rotor inlet aperture 254 registers with the secondary body inlet aperture 234 only when the rotor 240 is in the second position. The rotor inlet apertures and the body inlet apertures preferably correspond exactly in size and shape to one another.

In this embodiment, a rigid primary rotor tube 260 extends through the primary rotor outlet aperture 244 between the rotor endplates, and through the primary rotor inlet aperture 252. Preferably, a cylindrical extension 262 of the primary rotor passage 260 further extends through the primary body inlet aperture 232 so that the extension 262 is journaled within the aperture 232 of the second body endplate 224. A rigid secondary rotor tube 266 extends through the secondary rotor outlet aperture 246 to the rotor side plate 256 and then through the secondary rotor inlet aperture 254. The axis of this secondary rotor tube 266 is perpendicular to the primary rotor endplate 242 where they join and is coaxial to the secondary rotor outlet aperture 246. Where the secondary rotor tube 266 extends through the secondary rotor inlet aperture 254, they are coaxial, but at this location, secondary rotor tube 266 extends radially outwardly at an acute angle to the axis "A" as best seen in FIG. 15. The rotor tubes 260, 266, provide passages for air traveling through the rotor 240. Other rotor constructions could be used. For instance, a solid cylindrical core, having passages extending therethrough, would be equally suitable.

A shaft 270, extending from the outer side of the second rotor endplate 242, is coaxial to the longitudinal axis "A". Thus, shaft 270 extends through the shaft aperture 230 so that the rotor can be rotated about the axis "A" by rotating the shaft 270.

As previously mentioned, the best tone quality is achieved if sound waves traveling through the valves of the musical instrument encounter a minimum amount of resistance. The primary rotor tube 260 is thus preferably shaped in the slight S-curve previously described. As in the first embodiment, instrument tubes are mounted to the body in axial alignment with the body apertures so that a minimum amount of resistance is encountered during the transfer of sound waves between the instrument tubes and the rotor passages.

The secondary rotor tube 266 curves gently as it extends between the secondary rotor outlet aperture 246 and secondary rotor inlet aperture 254. It is desirable to maximize the radius of curvature to minimize resistance. By constructing this tube to extend through the rotor side plate 256 at an oblique angle, it is possible to use a large radius of curvature. This structure is particularly advantageous because, valves of a smaller diameter, at a given tube size, can be manufactured when only one aperture is located in the secondary rotor endplate 250. Such small diameter valves are especially well suited for use in compact instruments and instrument requiring short slide loops. Because the distance between the primary rotor outlet aperture 244 and secondary rotor inlet aperture 254 is very short, even the shortest slide loop can be positioned so that it's ends register with those apertures.

As previously described, the rotor 240 may be rotated between a first position in which the primary rotor outlet aperture 244 registers with the primary body outlet aperture 226 and a second position in which each of the rotor apertures registers with a body aperture.

In the embodiment of FIGS. 15 through 21, a valve according to the present invention is positioned between tubes which correspond to the tubes of a musical instrument. The main bore 274 of the instrument connects to the primary body outlet aperture 226. A lead pipe 276 extends from the mouthpiece of the instrument and is connected to the primary body inlet aperture 232. Opposite ends 278, 280 of a slide loop 277 connects to the secondary body outlet aperture 228 and the secondary body inlet aperture 234.

An exploded view of the valve shown in FIGS. 15 through 20 appears in FIG. 21. This figure shows several additional features which are useful when the valve is incorporated into a musical instrument. The body endplates 222 and 224 are provided with screw holes 282. The body 220 is provided with inwardly extending ears 284 having threaded holes. The holes 282 and threaded holes in the ears 284 are adapted to receive screws 286 which secure the body endplates to the body 220. As shown in FIGS. 16 and 19, the ears 284 act as stops to limit the rotation of the rotor 240.

This embodiment is also constructed for easy removal of the valve structure from the musical instrument. Mounting plates and one hemicylindrical casing segment are permanently attached to the instrument tubes and shaped to closely contain the valve assembly with the body endplates 222, 224, in contact with the mounting plates 290, 292 respectively. The main bore 274 and one end 278 of the slide loop 277 are permanently affixed to the mounting plate 290. The lead pipe 276 is likewise affixed to the other mounting plate 292. The other end 280 of the slide loop 277 is fixed to one segment 304 of the casing cover 302. The mounting plates and segment 304 are provided with orifices which exactly register with the orifices of the adjacent body endplate or body, when the valve assembly is properly positioned between the mounting plates. With the valve assembly in this position, screw holes 294 in the mounting plates register with threaded screw holes 296 so that screws 298 can secure the valve assembly in position.

The valve assembly is quickly removed from between the mounting plates 290, 292 be unscrewing the screws 298 and sliding the valve assembly from between the mounting plates. A slot 300 is provided in the mounting plate 290 through which the shaft 270 slides as the valve assembly is removed.

As mentioned, a casing cover 302 surrounds the body 220 and extends between mounting plates 290, 292 and comprises two hemicylindrical segments. One of the segments 304 is permanently mounted on the mounting plates 290, 292. The other segment 306 is removable to expose the valve assembly. By simply removing the screws 298, the entire valve be removed for servicing. The valve assembly itself may be completely disassembled by removing four additional screws 286.

The rotation of the rotor about the longitudinal axis "A" is illustrated in FIGS. 15, 18 and 22–23. FIGS. 18 and 22 show the rotor in the normal flow or first position. In this position, the primary rotor tube 260 connects the main bore 274 directly to the lead pipe 276.

When the rotor is rotated about the axis "A" to the second or diverted flow position shown in FIGS. 15 and 23, the secondary rotor tube 266 connects the main bore 274 with one end 280 of the slide loop, and the primary rotor tube 260 connects the other end 278 of the slide loop with the lead pipe 276. Thus, when the valve is in the first position, the sound waves can travel directly between the main bore 274 and the lead pipe 276. When the valve is in the second position, sound waves must pass through the slide loop 277 when traveling between the main bore 274 and the lead pipe 276.

FIGS. 24–27 depict the second valve according to the present invention incorporated in a musical instrument. More specifically, FIG. 24 shows a B-flat trombone which includes a single slide loop 277. By rotating the valve, the slide loop 277 may be added to the sound path so that the fundamental pitch of the trombone is lowered to the key of F. The trombone has a mouthpiece 308 and a slide 310 which are portions of the lead pipe 276. The lead pipe connects to the primary body inlet aperture of the valve. One end 278 of the slide loop 277 is connected to the secondary body inlet aperture. The other 280 is connected to the secondary body outlet aperture. The main bore 274 is connected to the primary body outlet aperture.

FIGS. 25–27, are enlarged views showing the second valve incorporated in a musical instrument. These views also show a means for rotating the valve shaft and rotor. This rotating means is of a common variety that employs a finger actuated key 312 rotatably mounted to a brace of the instrument and mechanically connected to the shaft 270 in such a manner that movement of the key causes rotation of the shaft. One or more stops of the type shown at 314 may be provided to limit movement of the rotor and thereby assure positive alignment between rotor apertures and body apertures.

The efficient operation of the valves according to the present invention is not affected by reversing the structure so that the main bore 274 is connected to the primary body inlet aperture 232 and the lead pipe 276 is connected to the primary body outlet aperture 226. Such reversed valves will operate in substantially the same fashion.

As mentioned in conjunction with the first embodiment, it is possible to include an additional pair of rotor tubes and additional sets of rotor and body apertures in a single valve assembly and thereby form a dual valve. A rotor for such a valve would appear similar to the rotor illustrated in FIGS. 13 and 14 except that the secondary rotor tube 166 and quatenary rotor 186 would be replaced with side-exiting rotor tubes of the type shown at 266 in FIGS. 15–23.

A suitable casing for such a dual valve would include three apertures in each body body end wall corresponding to the three apertures through each rotor end plate, and two apertures in the casing cover corresponding to the two apertures through cylindrical side plates of the rotor. Because rotor tube extensions would be journaled in axial apertures of both its body end plates, no shaft would be available to rotate the dual valve rotor. Other suitable means for rotating the dual valve rotor would need to be provided as described above.

While I have shown and described preferred embodiments of my invention, it will be apparent to those skilled in the art that changes and modifications may be made without departing from my invention in its broader aspects.

I claim:

1. A musical wind instrument comprising:

a lead pipe having a mouthpiece at one end thereof;

a main bore terminating in an instrument bell;

a slide loop;

a casing having two opposite ends and a body wall extending therebetween, said lead pipe and one end of said loop being connected to one of said opposite ends, said main bore being connected to the other of said opposite ends, and the other end of said loop being connected to said body wall;

a rotor rotatable in said casing having a primary rotor passage which directly connects said lead pipe to said main bore when said rotor is in a first position and which connects said one end of said loop to said main bore when said rotor is rotated to a second position, said rotor also having a secondary rotor passage which connects said lead pipe to said other end of said loop when said rotor is in said second position.

2. A musical wind instrument comprising:

a lead pipe having a mouthpiece at one end thereof;

a main bore terminating in an instrument bell;

a slide loop;

a casing having two opposite ends and a body wall extending therebetween said main bore and one end of said loop being connected to one of said opposite ends, said lead pipe being connected to the other of said opposite ends, and the other end of said loop being connected to said body wall;

a rotor rotatable in said casing having a primary rotor passage which directly connects said lead pipe to said main bore when said rotor is in a first position and which connects said lead pipe to said one end of said loop when said rotor is rotated to a second position, said rotor also having a secondary rotor passage which connects said other end of said loop to said main bore when said rotor is in said second position.

3. In a musical wind instrument having a slide loop, an instrument pipe with a mouthpiece at one end and an instrument pipe terminating in an instrument bell, the improvement comprising a rotary valve which includes:

a casing having a. a first end plate which defines primary and secondary body inlet apertures, b. an opposed, second end plate defining a primary body outlet aperture, and c. a body wall defining a secondary body outlet aperture and extending between said end plates, a rotor rotatable in said casing having a primary rotor passage which connects said primary body inlet aperture to said primary body outlet aperture when said rotor is in a first position and which connects said secondary body inlet aperture with said primary body outlet aperture when said rotor is rotated to a second position, said rotor also having a secondary rotor passage which connects said primary body inlet aperture to said secondary body outlet aperture when said rotor is in said second position, one of said instrument pipes connecting to said primary body inlet aperture, the other of said instrument pipes connecting to said primary body outlet aperture, one end of said loop connecting to said secondary body inlet aperture, and the other end of said loop connecting to said secondary body outlet aperture.

4. A valve according to claim 3 wherein:

the primary rotor passage is defined by a rotor tube extending through said rotor;

a cylindrical extension of said rotor tube extends outwardly from one end of said rotor at the rotational axis thereof; and said primary body outlet aperture receives said extension whereby said extension is journaled within said aperture.

5. In a musical wind instrument having a slide loop, an instrument pipe with a mouthpiece at one end and an instrument pipe terminating in an instrument bell, the improvement comprising a rotary valve which includes:

a rotor having a longitudinal axis of rotation and including a. a first end plate which has two rotor apertures extending axially therethrough, b. a second end plate which has a rotor aperture extending axially therethrough coaxial with said axis of rotation, c. an axially extending side plate having at least one rotor aperture extending radially therethrough, d. a primary rotor passage extending between said rotor aperture in said second end plate and a first peripheral rotor aperture in said first end plate, and e. a secondary rotor passage extending between said rotor aperture in said side plate and a second peripheral rotor aperture in said first end plate, said second peripheral rotor aperture being equally distant from said axis of rotation as is said first peripheral rotor aperture;

a closely fitting casing for said rotor within which said rotor is free to rotate about said axis of rotation, said casing having four body apertures simultaneously registrable with said four rotor apertures when said rotor is in a suitable position so that in reference to said rotor in said suitable position a. one of said instrument pipes connects to the body aperture in registry with said second peripheral rotor aperture in said first end plate, b. the other of said instrument pipes connects to the body aperture in registry with said rotor aperture in said second end plate, c. one end of said loop connects to the body aperture in registry with said first peripheral rotor aperture in said first end plate, and d. the other end of said loop connects to the body aperture in registry with said rotor aperture in said side plate; and rotation means for rotating said rotor in said casing.

6. A valve according to claim 5 wherein said secondary rotor passage diverges from said axis of rotation by less than 90° between said second peripheral rotor aperture and said rotor aperture in said side plate.

7. A valve according to claim 5 wherein a tangent to the axis of said secondary rotor passage, at said aperture in said side plate, defines an obtuse angle with the axis of said second peripheral rotor aperture.

8. A valve according to claim 5 wherein said secondary rotor passage has a uniform circular cross section and a center line which is a smooth curve.

9. A valve according to claim 8 wherein said center line:

defines a plane including said axis of rotation; and meets said side plate at such an angle that the intersection of said secondary rotor passage and said side plate substantially comprises an elipse having a major axis in said plane.

10. A valve according to claim 9 wherein said primary rotor passage is axially aligned with said axis of rotation at said one end of said rotor.

11. A valve according to claim 5 wherein:

said rotation means comprises a shaft fixed on said first end plate extending outwardly therefrom, said shaft having a longitudinal axis coaxial with said axis of rotation; and said casing includes a shaft aperture to receive said shaft.

12. A valve according to claim 11 further comprising a lever operably connected to said shaft for rotating the same.

13. A valve according to claim 12 further comprising:

stop means mounted on said casing to limit the rotation of said shaft so that said rotor can rotate only between two fixed positions; and spring means operably connected to said lever for urging said rotor to rotate toward one of said fixed positions.

14. A valve according to claim 5 wherein:

said rotor includes four additional rotor apertures, a tertiary rotor passage extending between an additional rotor aperture coaxial with said axis of rotation in said first end plate and one peripheral additional rotor aperture in said second end plate, and a quatenary rotor passage extending between an additional rotor aperture in said side plate and an other peripheral rotor aperture in said second end plate, said other peripheral additional rotor aperture being equally distant from said axis of rotation as is said one peripheral additional rotor aperture; and said casing includes four body apertures simultaneously registrable with said four additional rotor apertures when said rotor is in a suitable position.

15. In a musical wind instrument having a slide loop, an instrument pipe with a mouthpiece at one end and an instrument pipe terminating in an instrument bell, the improvement comprising a rotary valve which includes:

a rotor having opposed ends, an axially extending side and an axis of rotation extending through said ends;

said rotor including a primary rotor passage extending from said axis of rotation at one end of said rotor to a first position displaced from the axis of rotation at the other end of said rotor and a secondary rotor passage extending through said rotor from said side to a second position displaced from the axis of rotation at said other end of said rotor, said first and second positions being equally distant from said axis;

a casing for said rotor having four apertures simultaneously registrable with the ends of said passages when said rotor is in a suitable position so that in reference to said rotor in said suitable position:

a. one of said instrument pipes connects to the aperture in registry with the end of said secondary rotor passage at said other end of said rotor, b. the other of said instrument pipes connects to the aperture in registry with the end of said primary rotor passage at said one end of said rotor, c. one end of said loop connects to the aperture in registry with the end of said primary rotor passage at said other end of said rotor, and d. the other end of said loop connects to the aperture in registry with the end of said secondary rotor passage at said side of said rotor; and means for rotating said rotor about said axis of rotation.

16. In a musical wind instrument having a slide loop, an instrument pipe with a mouthpiece at one end and an instrument pipe terminating in an instrument bell, the improvement comprising a rotary valve which includes:

a tubular body defining a substantially eliptical secondary body outlet aperture;

a first body end plate fixed on and positioned perpendicular to the longitudinal axis of said body at one end thereof and defining a circular primary body inlet aperture, a circular secondary body inlet aperture displaced the same distance away from said longitudinal axis as said primary body inlet aperture, and a circular shaft aperture coaxial with said longitudinal axis;

a second body end plate positioned opposite said first body end plate and secured to the other end of said body, said second body end plate defining a circular primary body outlet aperture coaxial with said longitudinal axis;

a first rotor end plate having a peripheral edge portion of a diameter slightly less than the inside diameter of said body, said first rotor end plate being positioned inside said body with one of its flat surfaces adjacent said first body end plate and defining primary and secondary rotor inlet apertures in alignment with and of substantially the same size and shape as said secondary and primary body inlet apertures respectively;

a second rotor end plate having a peripheral edge portion the same diameter as said first rotor end plate, said second rotor end plate being positioned inside said body with one of its flat surfaces adjacent said second body end plate and defining a primary rotor outlet aperture in alignment with and of substantially the same size and shape as said primary body outlet aperture;

a rotor wall portion having an outside diameter slightly less than the inside diameter of said body, said wall portion being positioned inside the body with its outer surface facing said tubular body, said wall portion defining a secondary rotor outlet aperture in alignment with and of substantially the same shape as said secondary body outlet aperture;

a rigid primary rotor tube extending between said primary rotor inlet aperture and said primary rotor outlet aperture, said primary rotor tube having a slight S-shaped curve so that its ends are axially aligned with the rotor apertures between which it extends;

a rigid, slightly curved secondary rotor tube extending between said secondary rotor inlet aperture and said secondary rotor outlet aperture, said secondary rotor tube being axially aligned with the rotor apertures between which it extends; and a shaft fixed on said first rotor end plate, said shaft being coaxially aligned with said longitudinal axis and extending through said shaft aperture whereby said rotor end plates and said rotor tubes are rotatable about said longitudinal axis between a first position wherein said primary rotor inlet aperture registers with said primary body inlet aperture and a second position wherein each of said rotor apertures registers with a body aperture;

one of said instrument pipes connecting to said primary body inlet aperture;

the other of said instrument pipes connecting to said primary body outlet aperture;

one end of said loop connecting to said secondary body inlet aperture;

the other end of said loop connecting to said secondary body outlet aperture.

17. In a musical wind instrument having a slide loop, an instrument pipe with a mouthpiece at one end and an instrument pipe terminating in an instrument bell, the improvement comprising a rotary valve which includes:

a first body end plate;

a second body end plate defining a plate outlet aperture, said second body end plate being in a fixed position directly opposite and parallel to said first body end plate;

said first body end plate defining two separate inlet apertures which are substantially equidistant from an axis of rotation extending perpendicular to said plates through said outlet aperture;

a tubular body portion defining a body outlet aperture;

a first rotor tube extending between said body end plates;

a second rotor tube extending between said tubular body portion and said first body end plate;

support means rotatable about said axis for holding said first and second rotor tubes in a fixed relationship to each other, said support means being rotatable between a first position wherein the ends of said first rotor tube register with said plate outlet aperture and one of said inlet apertures respectively, and a second position wherein opposite ends of said first rotor tube register with said plate outlet aperture and the other of said inlet apertures respectively and the ends of said second rotor tube register with said body outlet aperture and said one of said inlet apertures respectively;

one of said instrument pipes connecting to said one of said inlet apertures;

the other of said instrument pipes connecting to said plate outlet aperture;

one end of said loop connecting to said other of said inlet apertures; and the other end of said loop connecting to said body outlet aperture.

* * * * *